US008661975B2

(12) United States Patent
Feyerabend et al.

(10) Patent No.: US 8,661,975 B2
(45) Date of Patent: Mar. 4, 2014

(54) SHEET GUIDING APPARATUS, PRODUCTION SYSTEM FOR PRINTED PRODUCTS HAVING A SHEET GUIDING APPARATUS AND METHOD FOR PRODUCING PRINTED PRODUCTS

(75) Inventors: Heiko Feyerabend, Fellbach (DE); Udo Ganter, Freiberg Am Neckar (DE); Martin Haupt-Terlau, Erdmannhausen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 358 days.

(21) Appl. No.: 13/038,569

(22) Filed: Mar. 2, 2011

(65) Prior Publication Data

US 2011/0215512 A1 Sep. 8, 2011

(30) Foreign Application Priority Data

Mar. 2, 2010 (DE) ..... 20 2010 003 084 U
Feb. 9, 2011 (EP) ..... 11001028

(51) Int. Cl.
*B41F 13/24* (2006.01)
*B65H 39/10* (2006.01)

(52) U.S. Cl.
USPC ..... 101/232; 271/296; 271/303; 271/305

(58) Field of Classification Search
USPC ..... 101/232; 270/12–15, 45; 271/225, 296, 271/303, 305
See application file for complete search history.

(56) References Cited

U.S. PATENT DOCUMENTS

| | | | | |
|---|---|---|---|---|
| 3,307,441 | A | 3/1967 | Saunders et al. | |
| 3,527,460 | A * | 9/1970 | Lopez | 271/69 |
| 4,163,491 | A * | 8/1979 | Rock et al. | 198/836.2 |
| 4,746,107 | A | 5/1988 | Schneider et al. | |
| 5,730,056 | A | 3/1998 | Schmitt | |
| 6,019,714 | A | 2/2000 | Stäb | |
| 2005/0224205 | A1 | 10/2005 | Michler et al. | |
| 2008/0084591 | A1 * | 4/2008 | Rassatt et al. | 358/498 |
| 2009/0158902 | A1 | 6/2009 | Takashimizu | |

FOREIGN PATENT DOCUMENTS

| | | | |
|---|---|---|---|
| DE | 19523881 | A1 | 1/1997 |
| DE | 19629072 | A1 | 1/1998 |
| DE | 102004041471 | A1 | 4/2005 |
| DE | 102006055301 | A1 | 5/2008 |
| DE | 102008014972 | A1 | 9/2009 |
| WO | 9724284 | A2 | 7/1997 |

OTHER PUBLICATIONS

European Search Report dated Jun. 27, 2011.

* cited by examiner

*Primary Examiner* — Ren Yan
(74) *Attorney, Agent, or Firm* — Laurence A. Greenberg; Werner H. Stemer; Ralph E. Locher

(57) ABSTRACT

A sheet guiding apparatus with a sheet diverter function, a production system with a printer and a folding machine for printed products, in which such a sheet guiding apparatus is used, and a method for producing printed products with the production system, permit productivity to be raised without increasing the operating speed of the folding machine.

8 Claims, 10 Drawing Sheets

SHEET GUIDING APPARATUS, PRODUCTION SYSTEM FOR PRINTED PRODUCTS HAVING A SHEET GUIDING APPARATUS AND METHOD FOR PRODUCING PRINTED PRODUCTS

CROSS-REFERENCE TO RELATED APPLICATION

This application claims the priority, under 35 U.S.C. §119, of German Patent Application DE 20 2010 003 084.6, filed Mar. 2, 2010, and European Patent Application EP 11 001 028.7, filed Feb. 9, 2011; the prior applications are herewith incorporated by reference in their entirety.

BACKGROUND OF THE INVENTION

Field of the Invention

The invention relates to a production system for flat printed products having a printing press and, as viewed in a transport direction, a following intermediate processing and transfer station and at least one following folding station, in particular a pocket folding station, in which the printed products can be transported in an uninterrupted material flow through the production system. The invention also relates to a sheet guiding apparatus for a production system according to the invention or for a sheet folding machine, including a sheet diverter for dividing a stream of sheets to a plurality of transport tracks, and at least a first and a second transport track. The invention further relates to a method for producing printed products of n different types in a production system having a digital printing press, a sheet folding machine and a sheet guiding apparatus with a switchable sheet diverter having n switching positions for transferring to one of n following transport tracks, in which the sheet guiding apparatus is configured, in particular, according to the invention.

Pocket folding machines and knife folding machines are known from the prior art for producing printed products such as brochures, pamphlets, booklets, signatures or the like. The combination of pocket folding machines with knife folding machines is customary as a combined folding machine. In that case, parallel folds are folded in pocket folding units and cross folds are folded in the following knife folding units. In that case, the sheet runs through at least the following stations in a running through direction of the combined folding machine: feeder, transfer table, pocket folding unit, knife folding unit, delivery.

In that case, sheets are fed in portrait format in a feeder, and parallel folds are folded in a first folding station in pocket folding units and cross folds are folded in a following folding station in knife folding units. German Published Patent Application DE 10 2006 055 301 A1 discloses combined folding machines with a plurality of pocket folding units and knife folding units which are disposed in a subordinate manner.

The construction of a pocket folding machine with a multiplicity of pocket folding units is apparent from German Published Patent Application DE 10 2004 041 471 A1. In that case, sheets are fed in portrait format in a feeder, and parallel folds are folded in a first folding station in pocket folding units and further parallel folds are folded in a following second folding station in pocket folding units. In that case, the second folding station is rotated by 90° with respect to the first folding station. In that case, a respective pocket folding unit is formed of a folding pocket and three folding rolls which are disposed in two folding roll pairs.

Transverse feeding of the folding sheets requires an adaptation of the folding patterns and affords additional options to save paper and time. According to the prior art, the speed problem has previously been moved to the second folding station in the case of transverse feeding. Although the reduced inlet length had an effect in the feeder and in the first parallel folding unit, the full inlet length had to be transported again to the second station which is rotated by 90 degrees. A very high speed of the second station was therefore necessary, which could lead to folding problems and reductions in quality.

Combinations of printing presses with folding machines are also known from the prior art. For instance, German Published Patent Application DE 195 23 881 A1, corresponding to U.S. Pat. No. 5,730,056, discloses a rotary printing press with a further processing unit which is connected behind it and has different folding stations, namely folding cylinders and knife folding units. A digital printing press with a folding machine which is connected behind it is apparent from German Published Patent Application DE 196 29 072 A1, in which the folding machine has pocket folding units.

Speed problems also occur in production systems of that type. In printing presses, either webs or sheets at a small spacing are printed at high speed. Due to speed limits in the following folding machine, the printing press can be operated only at a reduced speed if the printing press and folding machine are coupled directly.

SUMMARY OF THE INVENTION

It is accordingly an object of the invention to provide a sheet guiding apparatus, a production system for printed products having a sheet guiding apparatus and a method for producing printed products, which overcome the hereinaforementioned disadvantages of the heretofore-known apparatuses, systems and methods of this general type and which increase the productivity of a production process in the production of printed products, in particular of signatures, brochures, newspapers and books, without an increase in the speed of a folding machine used in the production.

With the foregoing and other objects in view there is provided, in accordance with the invention, a production system for flat printed products, comprising a printing press and an intermediate processing and transfer station which is disposed so as to follow the printing press, as viewed in the transport direction, that is to say downstream. At least one folding station, in particular a pocket folding station, is disposed further in the following direction, that is to say further downstream. The printed products can be transported in an uninterrupted, continuous material flow through the production system, that is to say there is no intermediate storage with a required intervention of the machine operator for renewed feeding. Uninterrupted therefore does not mean in this case that the printed products have to be transported without a spacing. According to the invention, a sheet guiding apparatus having a switchable sheet diverter is disposed between the intermediate processing and transfer station and the at least one folding station. The sheet diverter serves to transfer the printed products onto a first or a second transport track. The use of the sheet guiding apparatus advantageously achieves a situation where the at least one folding station no longer represents a chokepoint (or so-called bottleneck) in terms of production technology of the production system. Since the sheet guiding apparatus makes it possible to guide the flat printed products either onto a first or a second transport track and to feed them to a further processing device, the processing speed of the at least one following folding machine no longer has to be increased in order to increase the production output of the production system.

In accordance with another particularly advantageous and therefore preferred embodiment, the printing press is a digital printing press. This ensures that printed products with different contents or printed products which are formed of a plurality of differently printed individual sheets can be produced following one another by the production system and without a great amount of time for machine changeovers.

In accordance with a further preferred structural variant, the printing press is configured as a web-fed printing press, and the intermediate processing and transfer station has a cross cutter for dividing a printing material web into individual sheets. As a result, the folding accuracy of sheet folding stations and the cost advantages of the material costs of a printing material web in contrast to a printing material individual sheet stack can advantageously be combined with one another.

In accordance with an added advantageous embodiment, the intermediate processing and transfer station can have a gathering device for forming stacks of individual sheets. This can, for example, be a so-called a drum gatherer which is optionally equipped with a glue application device for joining the individual sheets. The individual sheets can also be individual sheets with different printed contents which are together to form a printed product, for example a signature. The stack which is formed by the gathering device can then be transferred to a folding station which is disposed so as to follow it and can be folded there to form a brochure.

In accordance with a first structural variant (see FIG. 6B), the transport directions of the first and second transport tracks lie parallel to one another and in one plane, and the printed products can be fed on the transport tracks to a following pocket folding station. In this structural variant, the individual sheets can be guided by the sheet guiding apparatus alternately to the first and second transport tracks, with the result that the sheets can move into the following pocket folding station at a greater sheet spacing. This advantageously permits the folding stations to be operated at a lower speed with constantly high productivity, which in turn results in even higher folding accuracy.

The productivity of pocket folding machines can therefore be increased considerably by the use of a sheet guiding apparatus according to the invention. Two aspects contribute substantially to this: A transverse feed of the sheets to be folded in the feeder or a provision of sheets in landscape format by the cross cutter of the intermediate processing and transfer station together with a sheet guiding apparatus in front of the second folding station. As a result of the lower inlet length of the sheet at an identical machine speed, the performance increase lies at approximately 30 percent depending on the sheet format.

The sheet guiding apparatus makes it possible to guide the folded sheets alternately to two (or more) transport tracks, to align them in parallel on two (or more) guides and to transport them to the second folding station. Since twice as many folded sheets can be transported in this way, the speed of the second station can therefore be reduced by half. As a result of the transverse entry of the sheet in the first parallel folding unit at a constant machine speed, firstly the productivity is increased considerably and secondly, as a result of the low speed of the second station, the folding quality is improved and the folding process is made more stable.

In accordance with a second structural variant (see FIG. 6B), the transport directions of the first and second transport tracks are disposed substantially at right angles with respect to one another, and can lie in substantially parallel planes or in one plane in this case, and the printed products can be fed to a first folding station on the first transport track and to a second folding station on the second transport track. That is to say, a first folding station is situated downstream of the first transport track and a second folding station is situated downstream of the second transport track. In this case, the two folding stations can either be operated in parallel, or only one of the two folding stations is used to produce the printed products, while the second folding station can already be preset for a following production job. A production system which is configured in this way is particularly advantageous when the printing press is a digital printing press, since thus the machine down time of the production system between two different production jobs can be reduced to a minimum or can be dispensed with completely.

In accordance with yet another advantageous development of one of the above-described production systems, the sheet guiding apparatus has a guiding device for transferring a printed product onto the second transport track. In other words, the guiding device serves to bridge the first transport track. Possible refinements of the guiding device will be described further below.

With the objects of the invention in view, there is furthermore provided a method for producing printed products of n different types, with n being equal to 1, 2, 3 . . . and a natural number. The method is carried out in a production system, having a digital printing press, a sheet folding machine and a sheet guiding apparatus, which can be configured, in particular, as described in the above text. The sheet guiding apparatus is configured as a switchable sheet diverter with n switching positions for transferring the printed products onto one of n following transport tracks. In this case, the method comprises the following steps: first of all, a printing material is printed with an n-th printing content. If the printing material is a printing material web, it is subsequently divided into individual printing material sheets. Thereupon, the printing material sheets are folded to form signatures. They are then guided further by the sheet guiding apparatus onto one of the n transport tracks. Thus, for example, a first signature which has been folded from printing material sheets which have a first printing content is guided onto the first transport track. If a printed product of the n-th type is formed of a plurality of signatures, the above-described steps are repeated and the signatures are gathered, for example in a delivery. All of these steps are also carried out to produce the further types of printed products. It is not necessary in this case that first of all a complete product of the n-th type be finished before a printed product of another type is produced. A parallel production of this type having different types of printed products is made possible by the sheet guiding apparatus which has a sorting function.

A method of this type therefore allows different products to be produced on the same production line and to be delivered physically separately from one another. As a result, the productivity of the production system which is used can be increased advantageously. It is no longer required to provide a plurality of production systems for different products. Instead, one production system is sufficient, with it also being necessary to preset only this one production system for job preparation. The outlay for presetting work can therefore be reduced.

In accordance with another advantageous development of the method according to the invention, the printing content which is printed onto the printing material by the digital printing press has an identification feature for identifying the type of printed product (such as a barcode, for example a linear code or a data matrix code). This identification feature is read by a detection system which is situated upstream of the sheet guiding apparatus and brings about an actuation of the sheet guiding apparatus. If, for example, the detection system determines that the printed product is a printed product of the first type, the sheet guiding apparatus is adjusted into its first switching position, with the result that the printed product is guided onto the first transport track. Furthermore, it is advantageous to provide additional monitoring and control systems (for example, barcode reading units and/or cameras) in the further processing course, for monitoring the product quality.

In accordance with a further advantageous development of the method according to the invention, printed products of two types are produced, the printed product of the first type being a main print and the printed product of the second type being a reprint. If there is a disruption in the main production which leads to individual products not passing or passing only with waste into the delivery station of the printed products, a reprint can be brought about immediately either by the machine operator or by a superordinate machine controller. In this case, the reprint is produced by the same production system. However, the sheet guiding apparatus is actuated in such a way that the reprint is separated physically from the main production and is guided onto the second transport track, with the result that the reprint is delivered separately from the main print. The reprint can be manually fed to the printed product later at the correct location. In contrast to the previously stated sequential processing of main print and reprint, this method variant according to the invention considerably increases the productivity of the production system which is used.

In accordance with one alternative development of the method according to the invention, printed products are produced in different versions. In this case, they can be, in particular, different language versions (for example, German, English, French) or different country versions (for example, Great Britain, USA, Australia) or different variant versions (for example, operating instructions for a pneumatic variant, or a hydraulic variant) or different container size versions (for example, a drug with 20 tablets or 100 tablets). These different versions are printed in any desired order on the digital printing press and are subsequently guided by the sheet guiding apparatus onto a transport track which is assigned to the respective version, and are therefore sorted. After folding has been carried out, the different versions of the signatures are delivered separately according to the versions and can therefore be forwarded separately to the end user. This method has the advantage that a larger number of variants can be produced inexpensively without losses in productivity. This is particularly significant for the production of printed products in small to medium runs.

The sheet guiding apparatus of the production system with the function of a sheet diverter can advantageously be configured as the sheet guiding apparatus which is described in the following text.

The sheet guiding apparatus can advantageously be actuated mechanically or pneumatically.

The sheet guiding apparatus can be integrated into a sheet folding machine in different ways. It can be fastened to the first folding station, it can be fastened to a transfer table which is disposed behind the first folding station, or it can be configured as an independent machine module with a supporting structure and rollers for displacing the module which can thus be positioned between the first folding station and the transfer table.

The sheet guiding apparatus can additionally be used for real double stream or multiple stream, in which the sheet is cut (dividing cut/center cut) in the first folding unit: the sheet diverter can be divided centrally for processing a double stream and is given two positions which can be rotated with respect to one another. By switching over to this permanent position, the first partial stream of the double stream is aligned on the first guide and the second partial stream of the double stream is aligned on the second guide and transported further to the second folding station. The sheet diverter is segmented for processing a multiple stream which is produced by more than one dividing cut into the folded signature. In other words: the sheet diverter is formed of a plurality of diverter parts which can be actuated individually. In this case, the diverter parts are actuated in groups in such a way that the extent of one group of diverter parts corresponds approximately to the extent of a signature transversely with respect to the sheet transport direction.

Customary folding machines are suitable in an optimum manner for use of the sheet guiding apparatus. In order to allow the sheets to enter in landscape, a pocket folding machine can be required which is one format class larger than the format class of the sheet. The necessary sheet guiding apparatus can be simply retrofitted in the customary folding machines.

Other features which are considered as characteristic for the invention are set forth in the appended claims.

Although the invention is illustrated and described herein as embodied in a sheet guiding apparatus, a production system for printed products having a sheet guiding apparatus and a method for producing printed products, it is nevertheless not intended to be limited to the details shown, since various modifications and structural changes may be made therein without departing from the spirit of the invention and within the scope and range of equivalents of the claims, noting that the invention and advantageous developments thereof as described also represent advantageous developments of the invention in any desired combination with one another.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
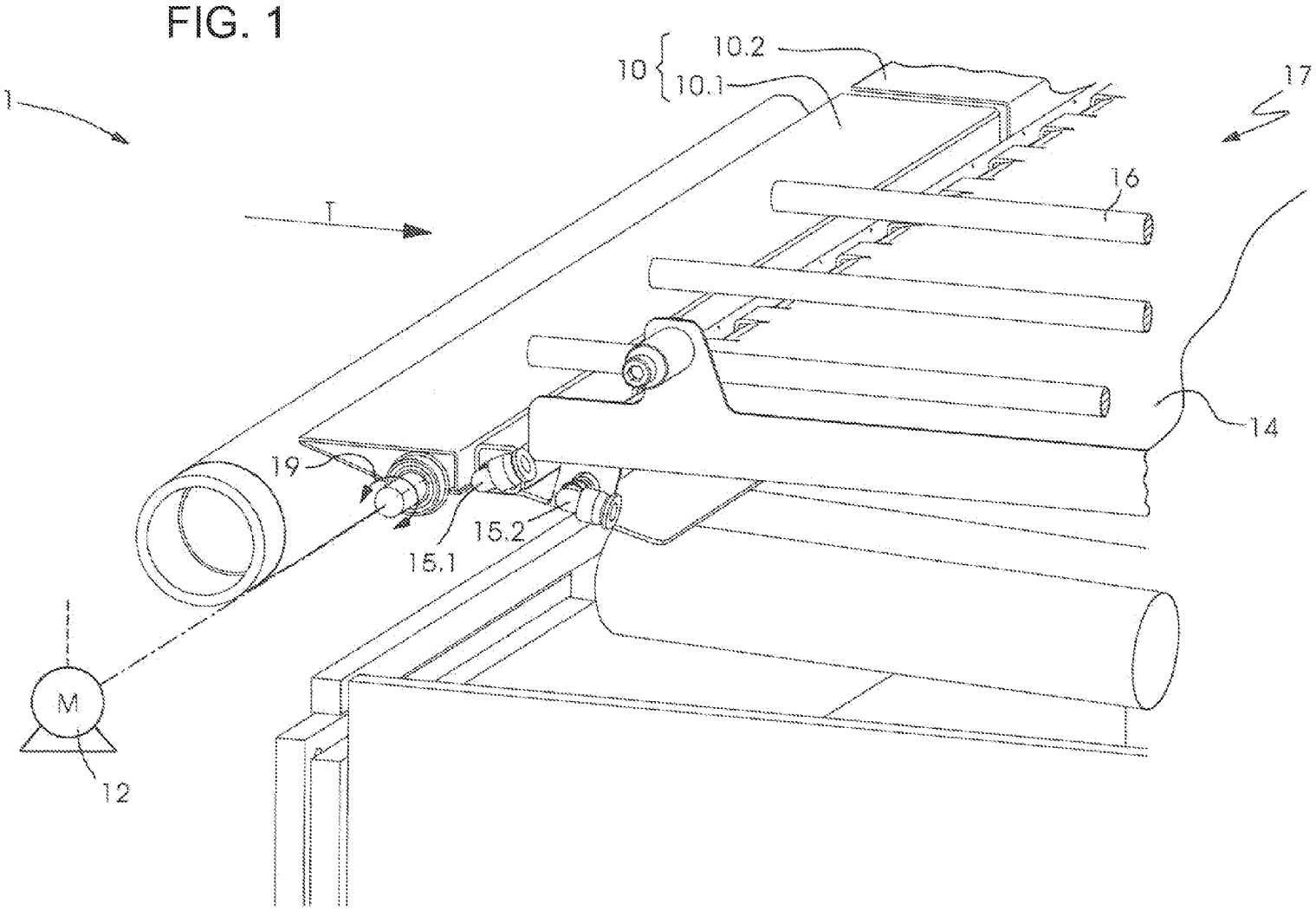
FIG. 1 is a fragmentary, diagrammatic, perspective view of a sheet guiding apparatus.

Referring now to the figures of the drawings in detail and first, particularly, to FIG. 1 thereof, there is seen a sheet guiding apparatus 1 which has a sheet diverter 10 that is formed of a right-hand diverter part 10.1 and a left-hand diverter part 10.2. The sheet diverter 10 can be moved between different positions thereof as a result of a switching movement 19 which is triggered by a drive 12, in particular a pneumatic cylinder. In the illustration of FIG. 1, the sheet diverter 10 is in its second position and a sheet which is fed in a sheet transport direction T is forwarded through a guiding device 17 onto a second transport track 3 (shown in FIGS. 2A-5). FIG. 1 shows a first embodiment of the guiding device 17, which has a guide plate 14, telescopic hold-down rods 16, upper blower nozzles 15.1 and lower blower nozzles 15.2. An air quantity of blown air which is introduced by the blower nozzles can be regulated. For example, a permanent air flow or a cyclical blown air flow can be provided, in order to thus apply an additional thrust force to the sheets in the guiding device 17 and therefore to ensure reliable transport into a first transport track 2 and the second transport track 3 (shown in FIGS. 2A-4). The blown air which is provided at the upper blower nozzles 15.1 also reduces friction between the sheet and the guide plate 14, since the sheet can slide on an air stream.

In one embodiment which is not shown, the guide plate 14 can be provided with venturi nozzles.

Figure 2A:
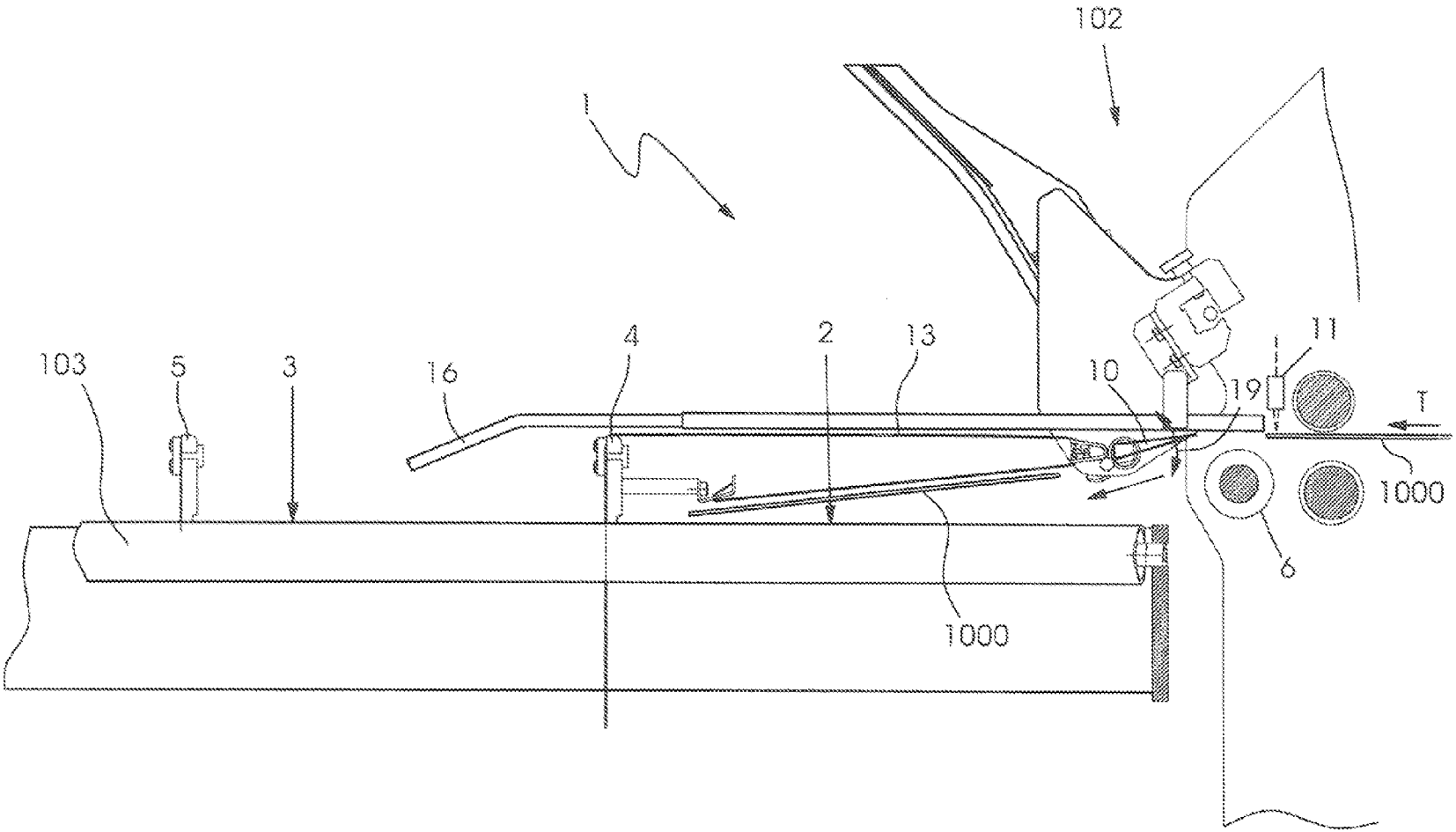
FIG. 2A is a side-elevational view of the sheet guiding apparatus with a sheet diverter in a first position.
Figure 2B:
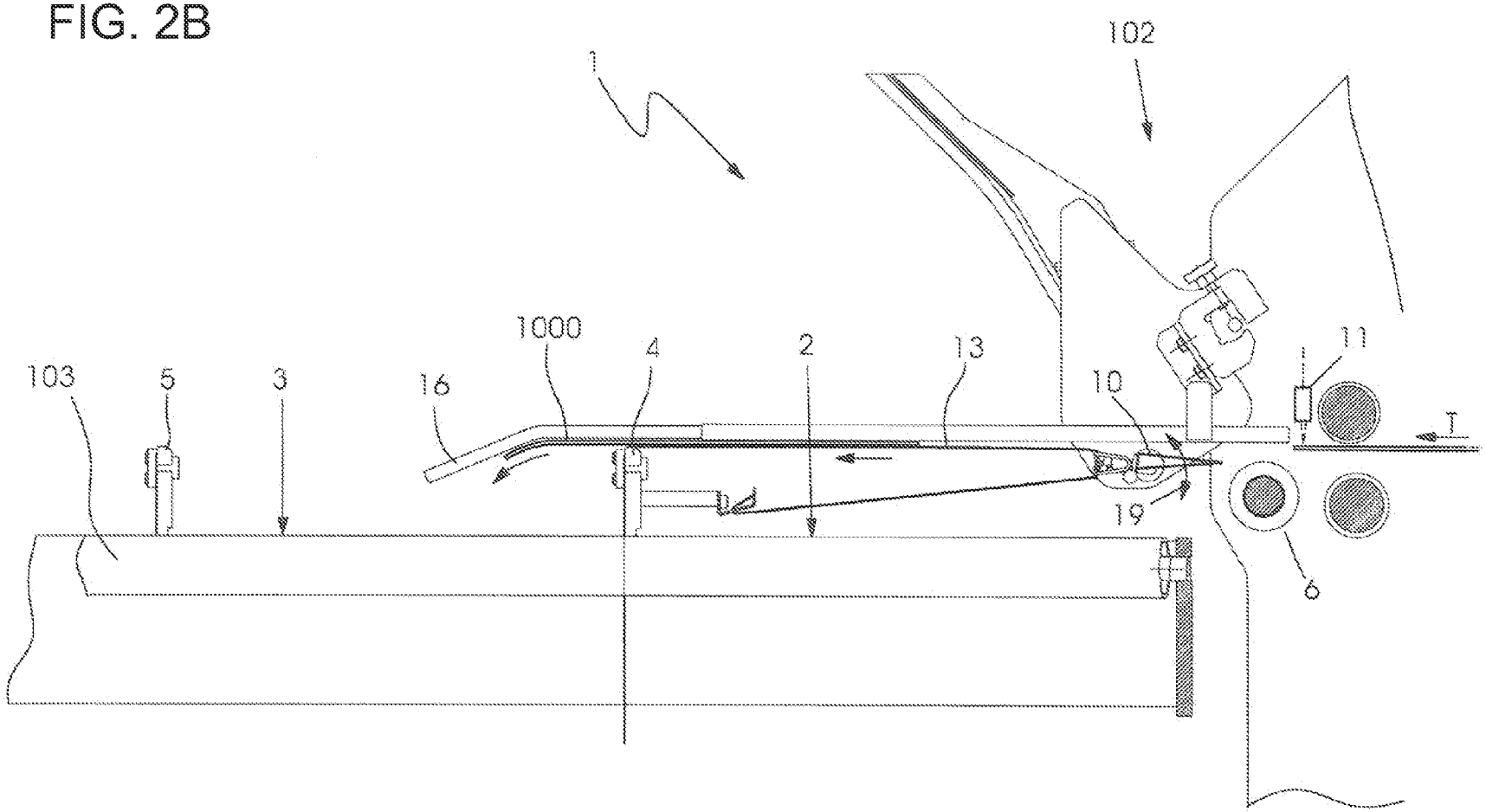
FIG. 2B is a side-elevational view of the sheet guiding apparatus with the sheet diverter in a second position.

A transfer movement of a sheet 1000 onto the first transport track 2 or the second transport track 3 as a result of the sheet guiding apparatus 1, is shown in greater detail in FIGS. 2A and 2B. In FIG. 2A, the sheet diverter 10 is situated in a first switching position and a sheet 1000 coming from a first pocket folding station 102 is guided to the first transport track 2 of a transfer table 103. At least one sensor 11, which detects an entry or exit of a sheet 1000, is disposed upstream of the sheet diverter 10 in the sheet transport direction T. One sensor can also be provided to detect the entry and another sensor can be provided to detect the exit. In addition, this sensor 11 or an additional non-illustrated sensor can be provided for reading a barcode which is situated on the sheet 1000. Upon every detection, the sensor 11 sends a control pulse to pneumatic cylinders (not shown in FIGS. 2A and 2B) which bring about a switching movement 19 in the sheet diverter 10.

The situation after the switching movement 19 has been carried out is shown in FIG. 2B: the sheet diverter 10 is situated in its second switching position and a sheet 1000 is guided over a grid 13 of the guiding device 17 onto the second transport track 3 of the transfer table 103. In this case, the telescopic hold-down rods 16 ensure that the sheet 1000 does not rise up and is transported reliably as far as the second transport track 3. As a result of their telescopic construction, the hold-down rods 16 permit simple adaptation to the positions of a first aligning guide 4 and a second aligning guide 5, and therefore to the format of the sheets 1000.

Figure 3:
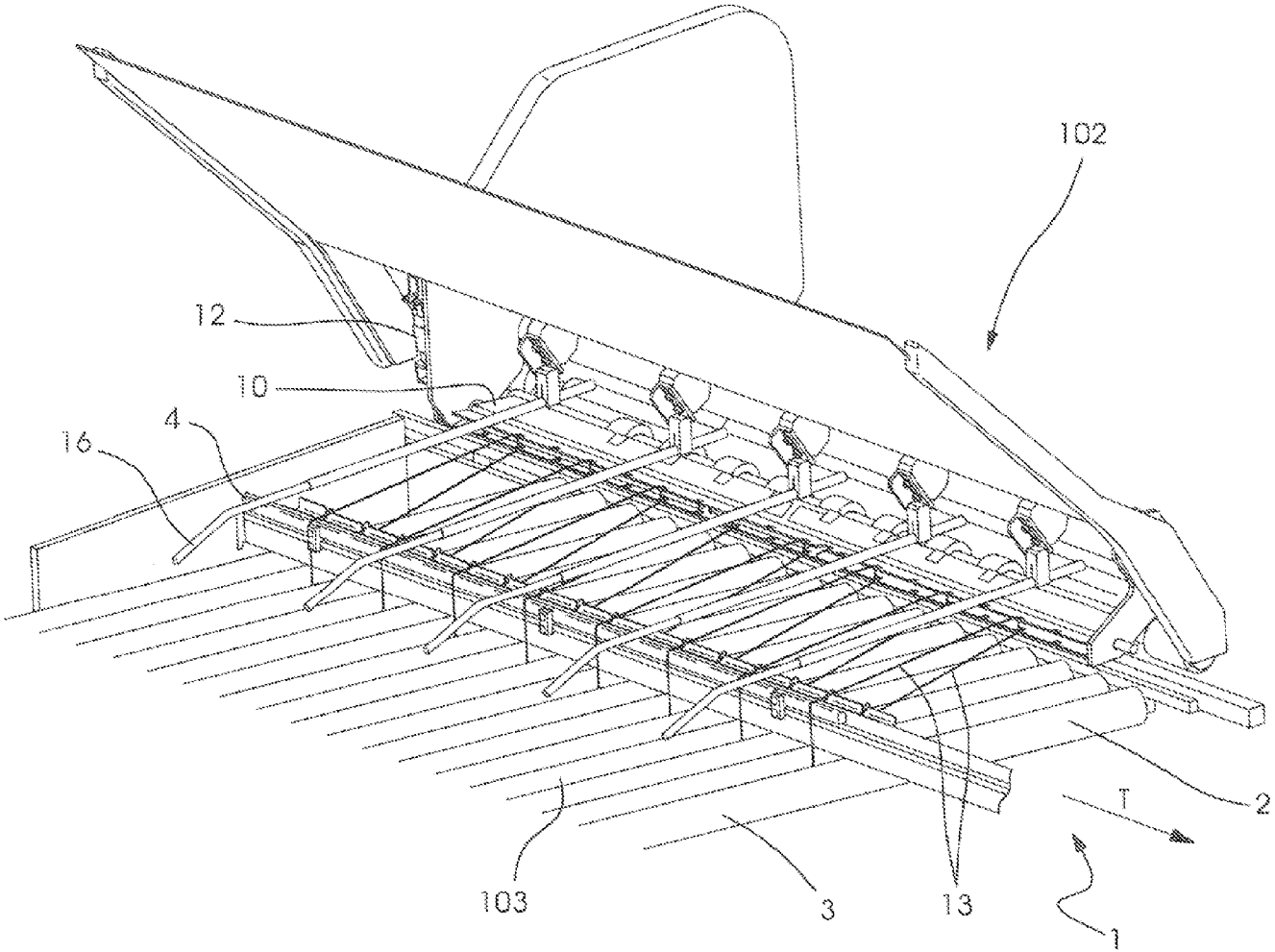
FIG. 3 is a fragmentary, perspective view of the sheet guiding apparatus with a guiding device in a second embodiment.

FIG. 3 shows a perspective, general illustration of the sheet guiding apparatus 1 with a guiding device 17, in a second embodiment: a grid 13 of tensioned cables forms a transport plane for transferring a sheet 1000 from the sheet diverter 10 to the second transport track 3. A second grid 13 including tensioned cables forms a slightly oblique guide face for transferring sheets 1000 from the sheet diverter 10 to the first transport track 2. A non-illustrated sheet 1000, which is transferred to the second transport track 3, is transported further in the sheet transport direction T through the use of slanted rollers of the transfer table 103 and in the process is aligned on the first aligning guide 4. The second aligning guide 5, which is disposed parallel to the first aligning guide 4, is not shown in FIG. 3.

In a third non-illustrated embodiment, the guiding device 17 can be configured as a belt section.

Figure 4:
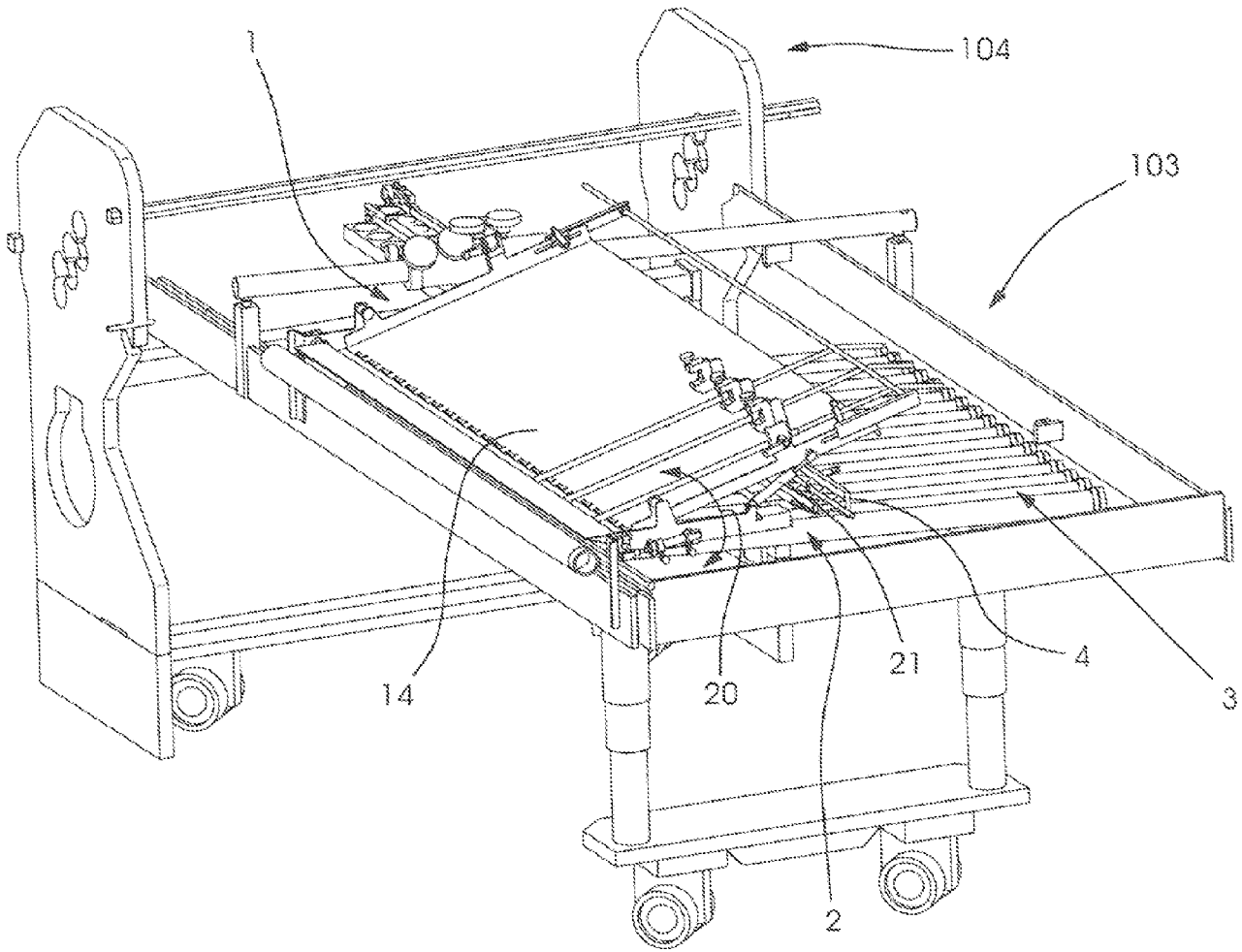
FIG. 4 is a perspective view of the sheet guiding apparatus, fastened to a transfer table.

The connection of the sheet guiding apparatus 1 to the transfer table 103 can be seen in FIG. 4. This makes satisfactory accessibility possible during the knife change in the first pocket folding station 102 (not shown in FIG. 4), since the sheet guiding apparatus 1 is also removed when the transfer table 103 is moved away and the region of the knife shafts of the first pocket folding station 102 therefore becomes freely accessible. As indicated in FIG. 4, the guide device 17 can perform a pivoting movement 20 with its guide plate 14, in order to make the first transport track 2 accessible and in this way to make it possible to manually remove jammed, clamped sheets 1000, which are so-called stoppages. In this case, the pivoting movement 20 can be brought about manually or can be brought about and/or assisted by any desired actuator, for example as shown in FIG. 4, by a pneumatic cylinder. If the movement is only to be assisted, a gas pressure spring can be provided.

Figure 5:
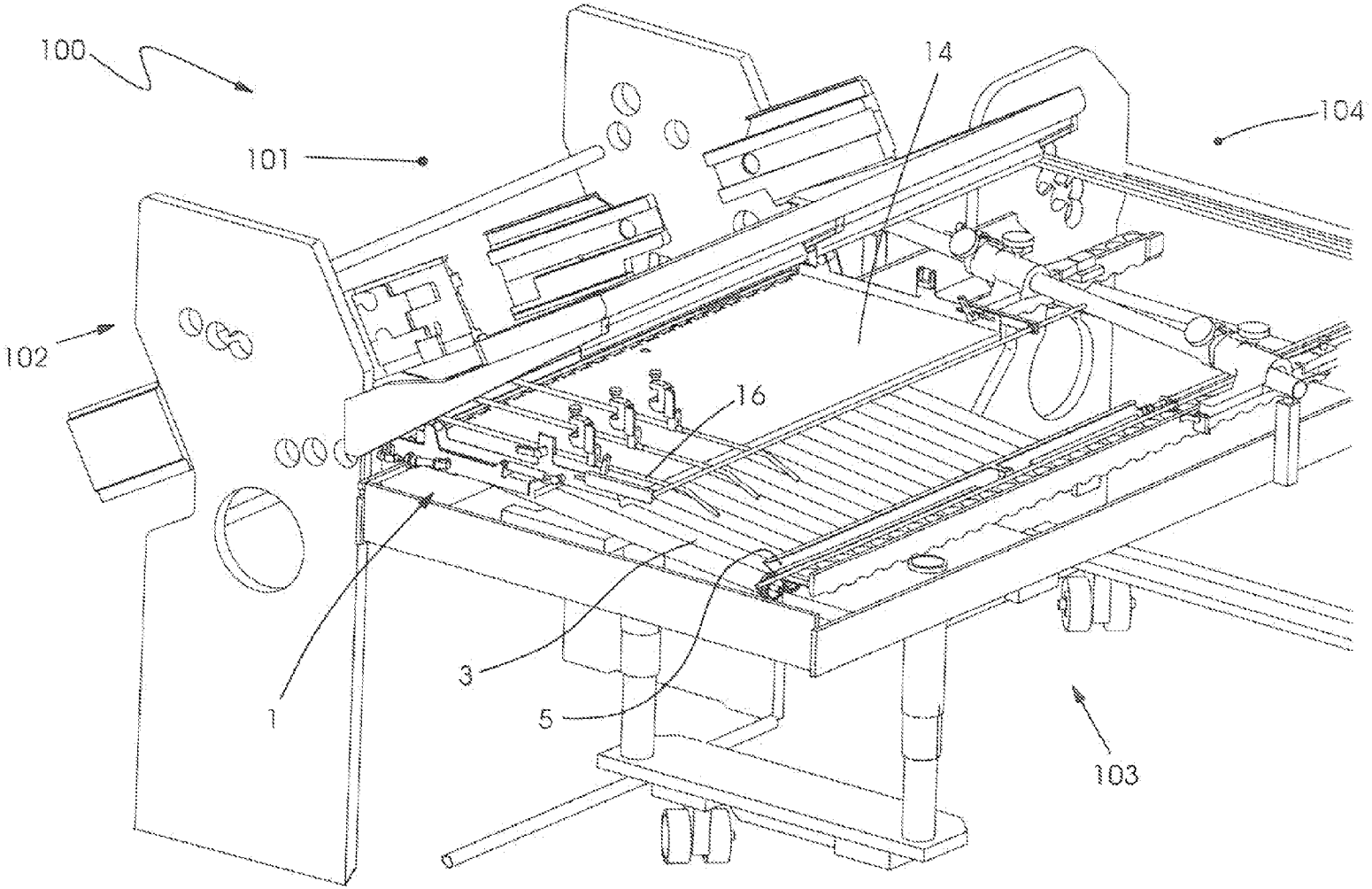
FIG. 5 is a perspective view of the sheet guiding apparatus, fastened to a first folding station.

FIG. 5 shows a sheet folding machine 100, having a first pocket folding station 102, the sheet guiding apparatus 1 and a transfer table 103 which is configured as a slanting roller table. A sheet feeder 101 is situated in front of the first pocket folding station 102 and the transfer table 103 is adjoined by a second pocket folding station 104 (see FIG. 4).

If a double stream of sheets 1000 is to be processed in the sheet folding machine 100, a rotary knife is situated in the first pocket folding station 102 for carrying out a separating cut or center cut. A sheet 1000 which comes from the feeder 101 is halved by way of the rotary knife, and two parallel sheet streams leave the first pocket folding station 102 and pass into the region of the diverter 10 of the sheet guiding apparatus 1. In order to transfer the first sheet stream to the first transport track 2 and the second sheet stream to the second transport track 3, the drive 12 for carrying out a switching movement 19 of the sheet diverter 10 is taken out of operation. The right-hand diverter part 10.1 and the left-hand diverter part 10.2 are then rotated manually with respect to one another in such a way that one of the two diverter parts 10.1 and 10.2 is situated in a first position and forwards a sheet stream to the first transport track, and the other of the two diverter parts 10.1 and 10.2 is situated in the second position and forwards a sheet stream to the second transport track 3. The two diverter parts 10.1 and 10.2, which together form the sheet diverter 10, are shown in FIGS. 1 and 3.

The figures only show the sheet diverter 10 in its first and second position. However, a further position can also be provided, in which waste sheets 1000 can be removed.

Figure 6A:
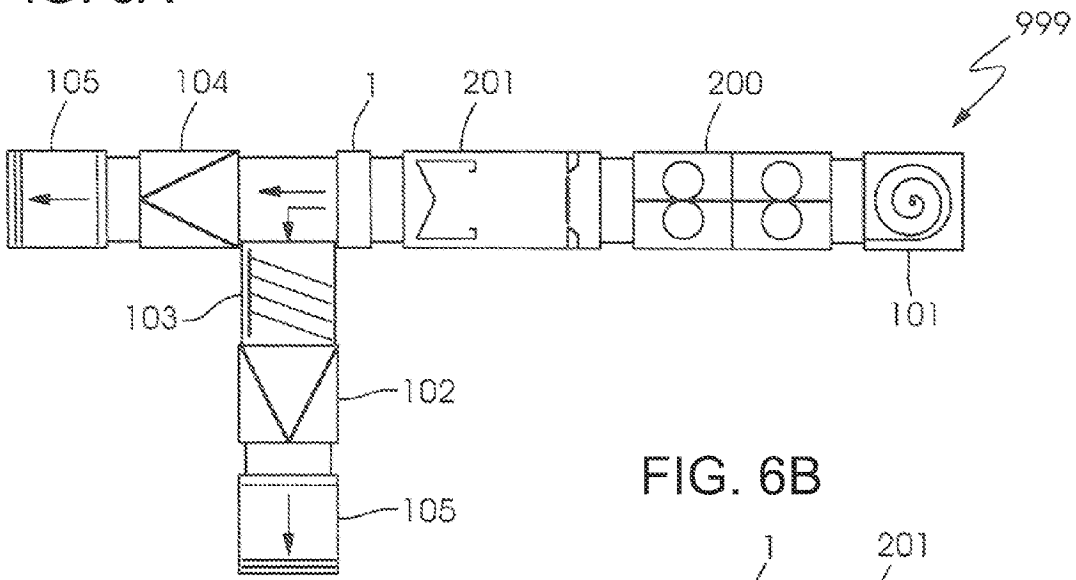
FIG. 6A is a plan view of a first embodiment of a production system according to the invention.

FIG. 6A shows a first variant of a production system 999 according to the invention: a printing material is fed by a feeder 101 to a printing press 200 and is printed there. The printing press 200 can be configured, as shown, as a web-fed printing press or, as an alternative, as a sheet-fed printing press. If the printing material is a printing material web, the web is subsequently cut to size to form individual sheets in an intermediate processing and transfer station 201. If the printing material is already in the form of individual sheets in the feeder 101, no cutting to size takes place in the intermediate processing and transfer station 201. The intermediate processing and transfer station 201 can additionally also be equipped with a gathering device which optionally forms sheet stacks from individual sheets. A sheet guiding apparatus 1, which has a sheet diverter 10, is situated downstream of the intermediate processing and transfer station 201. The sheet diverter 10 can be configured as described above. It is possible, by way of the sheet guiding apparatus 1, as indicated by arrows, to feed the sheets or stacks, in a first alternative, at an angle of 90° over a transfer table 103 to a first pocket folding station 102, where the sheets or stacks are folded. The signatures which are produced there can be delivered in a delivery 105 which is disposed downstream. As a second alternative, the sheets or stacks coming from the intermediate processing and transfer station 201 can be transported further by the sheet guiding apparatus 1 straight ahead into a second pocket folding station 104 and are subjected to a folding operation there. A delivery 105 for delivering the signatures is disposed behind the folding station 104.

In a first operating form, the sheet guiding apparatus 1 is actuated in a synchronized manner in such a way that sheets or stacks which come from the intermediate processing and transfer station 201 are forwarded alternately to the first pocket folding station 102 or to the second pocket folding station 104. Since the first pocket folding station 102 and the second pocket folding station 104 are fed the sheets or stacks with a different orientation, only different products can be produced. In a second operating form of the production system 999, only one of the two pocket folding stations 102, 104 is used for processing printed products, while the other of the two pocket folding stations 104, 102 can already be prepared for a subsequent job.

Figure 6B:
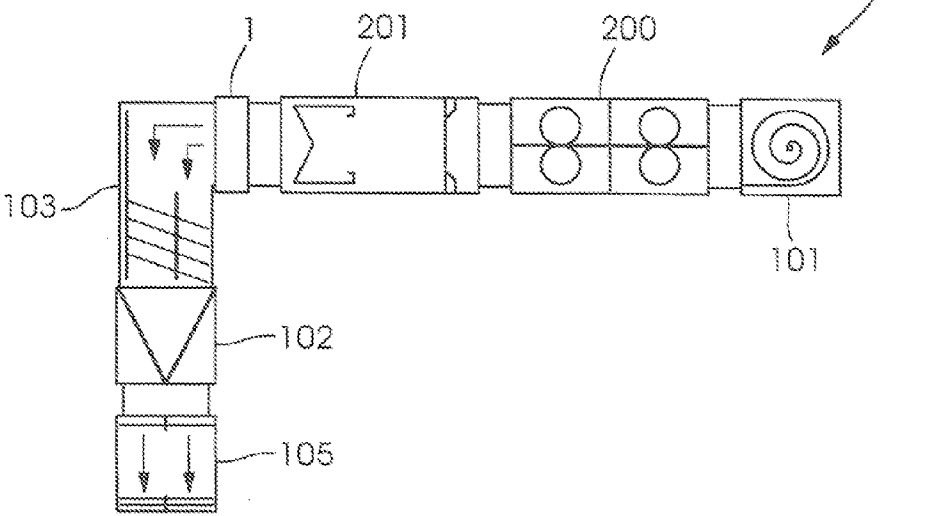
FIG. 6B is a plan view of a second embodiment of a production system according to the invention.

FIG. 6B shows an alternative structural variant of the production system 999 according to the invention. As has already been described using FIG. 6A, a printing material is printed by a printing press 200 and individual sheets or stacks are formed in an intermediate processing and transfer station 201. The stacks or individual sheets can be deposited by a sheet guiding apparatus 1 which is disposed downstream onto a plurality of alternative transport tracks which are situated in one plane and feed the sheets or stacks over a transfer table 103 to a pocket folding station 102, where the sheets or stacks are subjected to a folding operation. A delivery 105 is disposed downstream of the pocket folding station 102. The finished printing products can be delivered parallel to one another in the delivery 105.

Figure 6C:
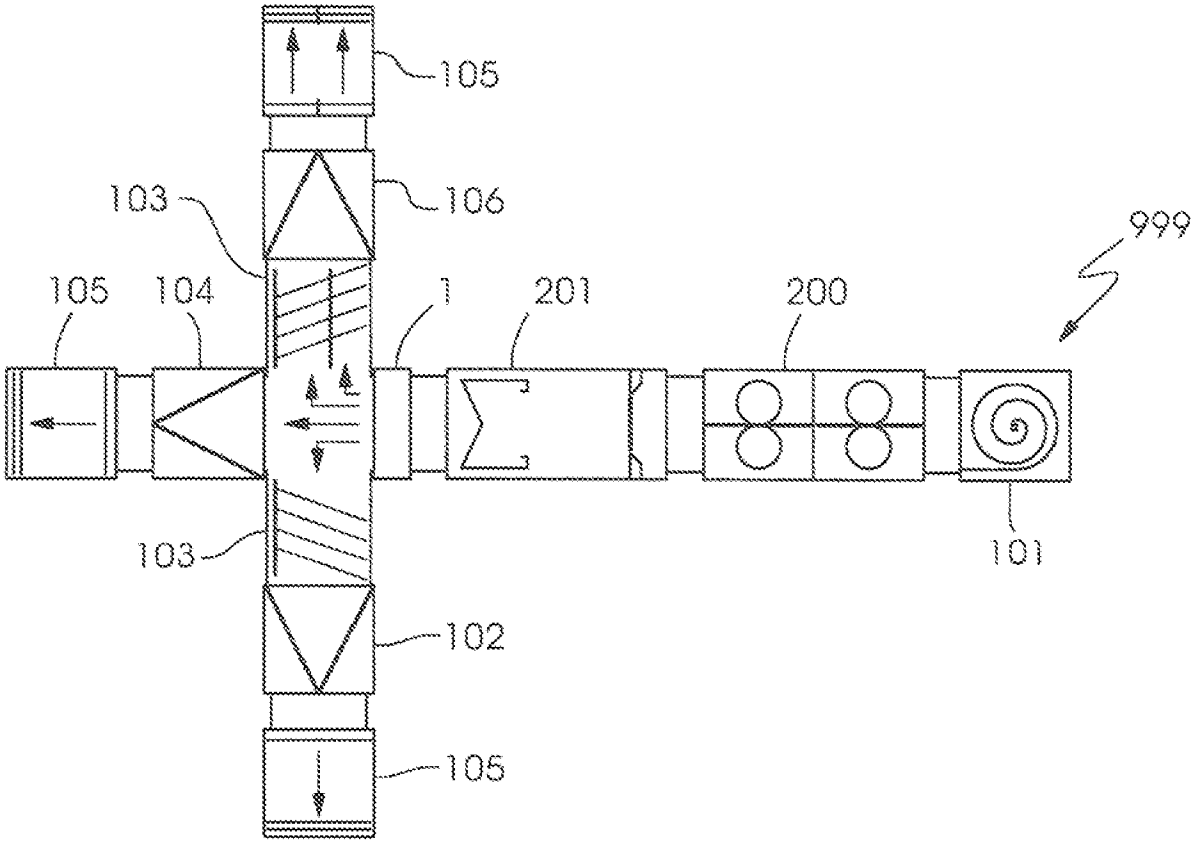
FIG. 6*c* is a plan view of a further embodiment of a production system according to the invention.

FIG. 6C shows an alternative structural variant of the production system 999 according to the invention. As has already been described using FIGS. 6A and 6B, a printing material is printed by a printing press 200 and individual sheets or stacks are formed in an intermediate processing and transfer station 201. The individual sheets or stacks can be deposited by a sheet guiding apparatus 1 which is disposed downstream onto a plurality of alternative transport tracks, and the sheets or stacks can be transported further either straight ahead, to the right or to the left. The further transport to the left and straight ahead has already been described by using FIG. 6A. The further processing in the case of transport to the right corresponds to the further processing which has been described using FIG. 6B. The number of transport tracks shown with aligning guides in the region of the transfer tables 103 is to be understood as exemplary in this case.

Figure 7:
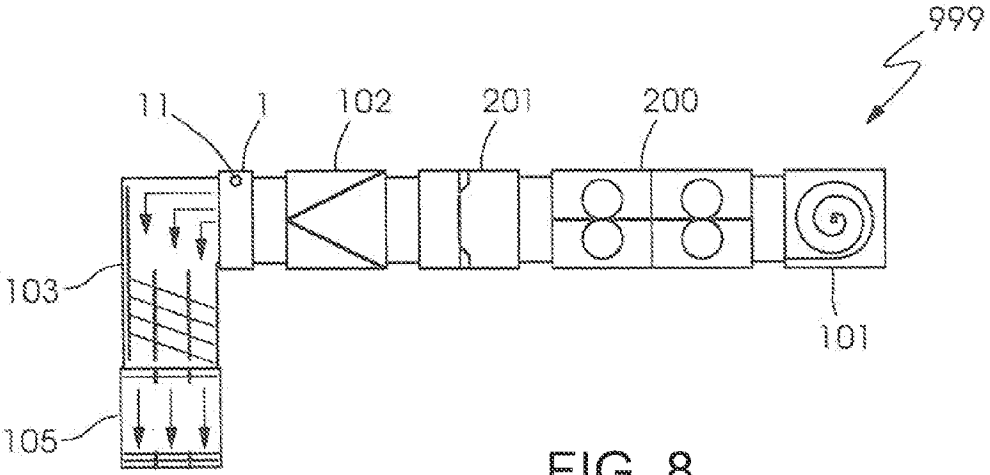
FIG. 7 is a plan view of another application of a sheet guiding apparatus.

FIG. 7 shows a third structural variant of a production system 999 according to the invention. A printing material coming from a feeder 101 is fed to a printing press 200 and is printed there. If the printing material is a printing material web, individual sheets are subsequently produced in an intermediate processing and transfer station 201. If individual sheets are already fed in by the feeder 101, the intermediate processing and transfer station 201 is not required. The individual sheets are folded to form signatures in the pocket folding station 102 which is disposed downstream. Subsequently, the signatures are sorted by a sheet guiding apparatus 1, and are fed on different transport tracks of a transfer table 103 to a delivery 105 and are delivered there. In the exemplary illustration of FIG. 7, three parallel transport tracks of the transport table 103 are provided, with the result that three stacks of finished products are produced in the delivery 105. The number of transport tracks shown is to be understood to be exemplary. Only two or more than three transport tracks can also be provided.

The products can be different versions. In one alternative embodiment, which is not shown in FIG. 7, a further pocket folding station, for producing cross folds, can be disposed between the transfer table 103 and the delivery 105, in a similar manner to that shown in FIGS. 6A and 6B. The production system 999 which is shown in FIG. 7 can be used particularly advantageously for producing printed products in different versions. As an alternative, the production system 999 can also be used to produce a main print and a reprint on the same production line.

Figure 8:
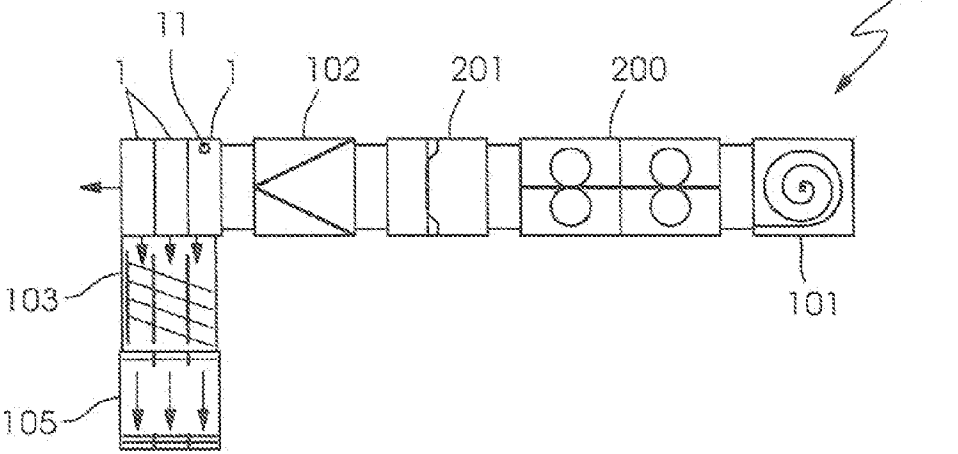
FIG. 8 is a plan view of a further application of a sheet guiding apparatus.

FIG. 8 shows a further structural variant of a production system 999 according to the invention. As has also already been described by using FIG. 7, folded products are produced by a pocket folding station 102. Instead of a sheet guiding apparatus 1 with three switching positions then being provided, three sheet guiding devices 1 are used which are disposed behind one another. If a product is not guided by the upstream sheet guiding apparatus 1 onto the first transport track, it is transported further into the next sheet guiding apparatus 1. If a product is not guided by the middle sheet guiding apparatus 1 onto the second transport track, it is transported further into the final sheet guiding apparatus 1. The latter can then either deposit the product onto the third transport track or remove it. If no removal possibility is to be provided, the final sheet guiding apparatus 1 can be omitted. Instead of a plurality of sheet guiding apparatuses 1, only one sheet guiding apparatus 1 can also be used with a plurality of sheet diverters 10, 10.1, 10.2 which are disposed in series.

Figure 9:
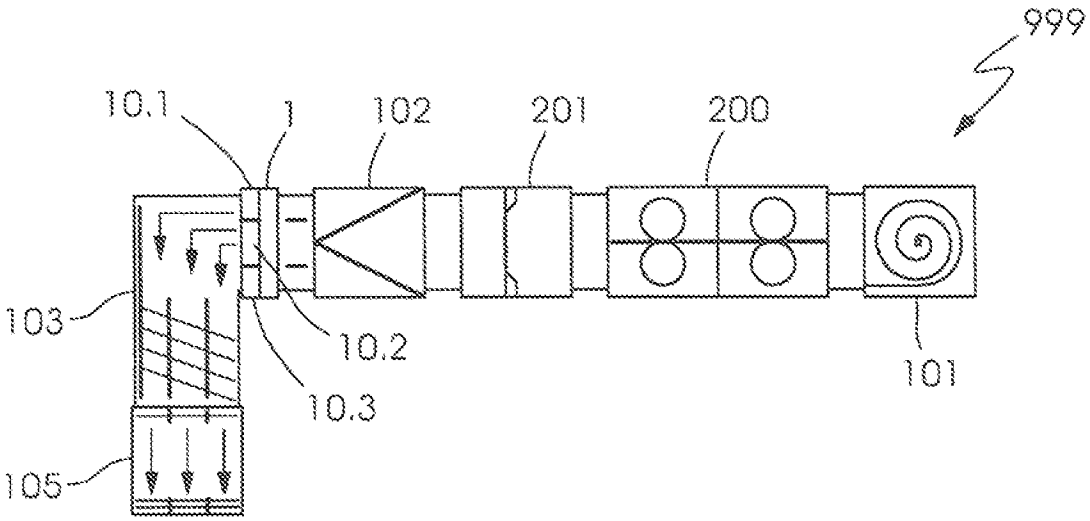
FIG. 9 is a plan view of a further embodiment of a production system according to the invention.

FIG. 9 shows a further structural variant of a production system 999 according to the invention. This variant represents a development of the variant which is described with regard to FIG. 7. After the products have been folded in the pocket folding station 102, two separating cuts take place, as a result of which the product is divided into three parts. The three parts are transported further as a multiple stream. To this end, the following sheet guiding apparatus 1 has a segmented sheet diverter 10 which has three diverter parts 10.1, 10.2 and 10.3. In this case, each of the diverter parts can be actuated separately (by a machine controller which is not shown herein). A respective diverter part can optionally be formed from a plurality of segments. If, for example, the sheet diverter 10 has six segments of the same format, in each case two segments are actuated in a grouped manner to form a diverter part. A respective stream of the multiple stream is guided onto one of the three transport tracks.

A sheet diverter 10 which is segmented in this way for separating a multiple stream can also advantageously be used in one of the above-described structural variants. If a plurality of sheet guiding apparatuses 1 are connected in series (as shown in FIG. 8) and are equipped with segmented sheet diverters 10.1, 10.2 (as shown in FIG. 9), this results in numerous options for sheet guidance and sorting options.

In non-illustrated variants, the web-shaped printing material can be printed in a separate printing press. The printing press 200 which is shown in FIGS. 6 to 9 is then omitted, and a printed web is provided by the feeder 101 (unrolling apparatus) which is shown.

The invention claimed is:

1. A sheet guiding apparatus for a production system or a sheet folding machine, the sheet guiding apparatus comprising:

a sheet diverter for dividing a stream of sheets being transported in a sheet transport direction to a plurality of transport tracks including at least one first and at least one second transport track;

said sheet diverter being divided centrally into right and left diverter parts relative to the sheet transport direction, said right and left diverter parts being mutually independently movable into first and second permanent positions for dividing a double stream of cut sheets; and said sheet diverter being multiply divided and formed of a plurality of diverter parts, said diverter parts all being mutually independently movable together into one of a plurality of switching positions for dividing a multiple stream of sheets alternately on either of said transport tracks with said sheet diverter being switchable at least between said first and second positions and with said sheet diverter being switched into said first position for guiding a sheet onto said at least one first transport track and into said second position for guiding a sheet onto said at least one second transport track.

2. The sheet guiding apparatus according to claim 1, wherein:

said sheet diverter has a plurality of switching positions, each of said switching positions is assigned to one of the plurality of transport tracks, or said sheet diverter is one of at least one plurality of sheet diverters connected in series and each of said sheet diverters is assigned to a respective transport track.

3. The sheet guiding apparatus according to claim 1, which further comprises:

at least one sensor for detecting a sheet running into or out of the sheet guiding apparatus;

a drive for switching said sheet diverter; and data lines directly or indirectly connecting said at least one sensor to said drive for transmitting a control pulse.

4. The sheet guiding apparatus according to claim 3, wherein said drive is a pneumatic cylinder or a hydraulic cylinder or an electric motor.

5. The sheet guiding apparatus according to claim 1, which further comprises a guiding device having at least one blower nozzle for providing a blown air flow to assist a transfer movement of a sheet to the first or second transport track.

6. The sheet guiding apparatus according to claim 5, wherein said at least one blower nozzle is disposed directly downstream of said sheet diverter in the sheet transport direction.

7. The sheet guiding apparatus according to claim 5, wherein said guiding device has substantially horizontal hold-down elements for holding down and/or deflecting a sheet being transferred onto the second transport track.

8. The sheet guiding apparatus according to claim 7, wherein said hold-down elements are configured as rods with telescopically extendable rod parts for adaptation of said hold-down elements to a format of the sheets.

* * * * *